United States Patent [19]

Nave

[11] Patent Number: 4,628,705

[45] Date of Patent: Dec. 16, 1986

[54] PORTABLE STORAGE CONTAINER

[76] Inventor: Thomas J. Nave, P.O. Box 2346, Bartlesville, Okla. 74005

[21] Appl. No.: 638,909

[22] Filed: Aug. 8, 1984

[51] Int. Cl.[4] ..... F25D 3/08

[52] U.S. Cl. ..... 62/457; 62/371; 62/530

[58] Field of Search ..... 62/430, 457, 371, 529, 62/530; 215/13 R

[56] References Cited

U.S. PATENT DOCUMENTS

| | | | |
|---|---|---|---|
| 2,187,387 | 1/1940 | Trigg et al. | 62/457 X |
| 3,213,641 | 10/1965 | Agee | 62/457 |
| 3,802,220 | 4/1974 | Pompo | 62/530 |
| 4,266,407 | 5/1981 | Gibson | 62/457 X |
| 4,281,520 | 8/1981 | Norwood | 62/430 X |
| 4,336,883 | 6/1982 | Krug et al. | 62/371 X |
| 4,351,165 | 9/1982 | Gottsegen | 62/457 X |
| 4,481,792 | 11/1984 | Groeger et al. | 62/457 |

*Primary Examiner*—Lloyd L. King
*Attorney, Agent, or Firm*—William S. Dorman

[57] ABSTRACT

A self-contained portable storage container styled in the form of a hollow attache case and characterized by an ability to maintain a plurality of objects contained therein at a desired cool temperature for relatively long periods of time, including a pair of symmetrical container halves, each half having an upper end, a lower end, two sides, and a plurality of internal recesses, so that in a closed position, the recesses of one half mate with the recesses of the other half to form cavities of predetermined sizes and shapes which are adapted to receive the objects in the cavities. Flexible straps connect the lower ends of the two halves together. Latches are provided at the upper ends of the two halves to hold them in closed position against each other. Each half has an outer wall and an inner wall spaced from the other wall so as to form a chamber for receiving a freezable liquid therein, the inner wall being connected to the outer wall along a plurality of spaced longitudinal ridges dividing the chamber into a plurality of longitudinal channels, each of the ridges being provided with a plurality of transverse passageways connecting the channels together so that a freezable liquid can flow from one channel to the next channel. Closeable openings are provided in each container half for introducing a freezable liquid into each chamber. The storage container is also provided with handles at the upper ends and raised feet at the lower ends so that the attache case can be supported on its own in an upright position.

3 Claims, 10 Drawing Figures

PORTABLE STORAGE CONTAINER

BACKGROUND OF THE INVENTION

1. Field of the Invention

The present invention relates to a portable cooling device for beverage containers and more particularly to a container that in and of itself can serve as a dispenser of beverages in a semi-solid or liquid form.

2. Brief Description of the Prior Art

For years, man has struggled with the problem of keeping liquids and various perishable and non-perishable foodstuffs cool and fresh during travel to the lake or park for picnics or to greater distances as during a long trip to one's parents in another city or state. Therefore, it would be desirable to use a device which would keep beverages and other foodstuffs chilled over a period of time which might span one to fifteen or more hours.

Many different forms of coolant containers have been produced since the development of lightweight plastic insulative materials. Plastic materials have been developed that are structurally stable in addition to having excellent heat insulation qualities. Other than the conventional "ice chests", most portable cooling containers depend entirely upon the insulative qualities of the "cooler" itself to keep the previously refrigerated items chilled.

Portability becomes a problem with bulky, conventional coolers, even for those designed specifically to carry a small number of cans or bottles as in the popular "six-pack". And, typically, there is no other provision made for a continuation of the cooling period which the beverage might require.

Accordingly, it is desirable to have a container for liquids (1) which is portable yet not bulky or cumbersome, (2) which can be easily stored or used for other purposes, (3) which can keep contents cooled over the duration of the outing by an internal supply of ice or other frozen beverage without diluting the liquid contents within said container, (4) which avoids the messiness of ice, (5) which is not bulky or weighty as are conventional ice chest hampers, (6) which accommodate a large variety of beverage containers and sizes as found in today's market, and (7) which is inexpensive to manufacture and to purchase.

A preliminary patent search was conducted in relation to the present invention and the following patents were uncovered in the search:

| Inventor | U.S. Pat. No. | Date |
|---|---|---|
| Lobl | 2,496,296 | February 7, 1950 |
| Palmer | 3,401,535 | September 17, 1968 |
| Sewitch | 3,565,277 | February 23, 1971 |
| Pompo | 3,802,220 | April 9, 1974 |
| Starrett | 3,974,658 | August 17, 1976 |
| Conklin | 4,019,340 | April 26, 1977 |
| Hotta | 4,238,934 | December 16, 1980 |
| Gibson | 4,266,407 | May 12, 1981 |
| Norwood | 4,281,520 | August 4, 1981 |
| Taylor | 4,286,440 | September 1, 1981 |
| Atkinson | 4,295,345 | October 20, 1981 |
| Motsenbocker | 4,420,097 | December 13, 1983 |

U.S. Pat. No. 2,496,296 to Lobl discloses a large, rectangular, picnic-style container suitable for holding and preserving in palatable and cooled condition several smaller containers therein. The latter, which would contain various solid and liquid foods and beverages, could be selectively arranged in various configurations to fit between plastic, removable dividing or lining walls.

U.S. Pat. No. 3,401,535 to Palmer discloses a reusable container formed with a recessed cavity layer capable of receiving loose items which require cooling prior to use. This recessed cavity layer can be lifted out to reveal a void which can be filled with a material that has been pre-cooled.

U.S. Pat. No. 3,565,277 to Sewitch discloses a binocular styled case in an elongated container form for carrying a plurality of beverage cans stacked one one top of another. These cans, which require cooling prior to use, fit within a metal housing which forms the unit's inner and outer walls. This unit contains a plug in this metal housing which seals an opening through which a permanent coolant can be introduced thereby maintaining a chilled condition for the beverage cans.

U.S. Pat. No. 3,802,220 to Pompo discloses a quilt-like sheet comprised of two layers of polyethylene material joined together by a bonded container thus forming a cooling cushion which when filled with a pre-cooled refrigerant gel which has not been frozen to a rigid state can be adapted to conform or fit many shapes and function as an inner liner for a container.

U.S. Pat. No. 3,974,658 to Starrett discloses a completely self-contained, box-shaped, portable refrigeration unit capable of maintaining a constant temperature of food and beverage products placed therewithin. The unit utilizes an internal refrigeration cartridge filled with a gel substance and having a plurality of curved surfaces adapted to contact the side or end surfaces of the products which are nested within an outer insulating shell.

U.S. Pat. No. 4,019,340 to Conklin discloses a thermal container having a removable cover comprised of three layers as in a sandwich. The outer two layers form the frame of the cover and are adapted to receive a pre-cooled package of refrigerant gel which is placed therebetween so as to be able to conduct coolness to the enclosed contents of said thermal container when the cover is placed upon the main body of the container. The invention is also applicable to any wall section of any thermal container whether said section is removable or not.

U.S. Pat. No. 4,238,934 to Hotta discloses a constant temperature box formed of an outer container with an inner tray or shelf which is placed horizontally near the top of the outer container. The tray or shelf is made of a synthetic resin or aluminum alloy having the properties of heat transferability or heat resistance. The tray has an intake opening through which hot or cold substances may be instilled which could then cool or heat the contents of the outer container by convection air current circulation.

U.S. Pat. No. 4,266,407 to Gibson discloses a molded, two-piece, insulated storage container utilizing selectively-frozen cold packs which are completely removable and relatively small. These cold packs, after being removed from a freezer, are placed at the ends of beverage cans within the container and cool by the conduction method.

U.S. Pat. No. 4,281,520 to Norwood discloses a pair of hollow cooling modules, each of which contains a liquid refrigerant and is so insulated and so shaped as to fit around a beverage bottle, but which do not have to be removed when the user wishes to pour beverages.

U.S. Pat. No. 4,286,440 to Taylor discloses a cooler divided into two separate compartments by an insulated partition and having only one common cold pack which would keep one compartment cooler than the other. In fact, the cold pack generally forms a removable partition and closure for the beverage compartment.

U.S. Pat. No. 4,295,345 to Atkinson discloses a reusable container for carrying and cooling canned beverages. This concave-shaped container has a bottom section revealing a plurality of cylindrical compartments, and a correspondingly shaped top section which also contains a slow warming refrigerant gel packed within it's upper end.

U.S. Pat. No. 4,420,097 to Motsenbocker discloses a container made of an insulative layer of webbed, flexible sheet material having an inner compartment which may be filled with refrigerant materials and an outer compartment surrounding the inner one which communicates with a lengthy tube, a valve, and a nozzle. Gravity flow and the progressive collapse of the flexible sheet material allows for liquids to be dispensed.

It is, therefore, an object of this present invention to provide a portable cooling device for canned or other type beverages which fits a variety of sizes of containers in a manner which maximizes the internal cooling efficiency among these various sizes to maintain low temperatures over the extended duration of a long outing and incorporates a design in which the cooling mechanism, the container, and the carrying device are cooperative and function as a single unit, thus offering economy in manufacturing and purchasing.

A further object of the present invention is to provide a cooling device which is small, light in weight, has a means to be carried, can be adapted to also carry foodstuffs, is floatable, is easily stored, and can double as a seat and as an emergency canteen.

SUMMARY OF THE INVENTION

The present invention involves a portable cooling device for beverage containers and other objest to be cooled and, more particularly, to a cooling device that, in and of itself, can serve as a dispenser of beverabes in a semi-solid or liquid form. The portable cooling device includes a pair of container halves which are symmetrical. When placed together in closed position, the attache case is essentially in the form of a rectangular parallelepiped. Each half or section is made of a floatable, hollow, thermoplastic outer skin or shell having high heat insulative properties. Each section rests on a pair of raised feet spaced at the bottom between a pair of connecting straps which permit the two sections from becoming separated from one another and which hold the lower ends of the sections in a closely adjacent but articulated relationship.

Each section has a cord handle attached to the top. Each section is also provided with latches consisting of notches and notched snapping flaps which are disposed opposite each other. More particularly, each container half has one notch and one snapping flap at the top with the notch of one half being opposite from the flap of the other half. In closed position, the snapping flap can be disposed over the notch to lock the flap against the notch and hold the attache case in a closed and locked position.

As far as the internal configuration of each container half is concerned, each container half is formed of an outer shell or wall and an inner shell or wall spaced from the outer shell to form a chamber into which a freezable liquid can be introduced. The inner wall is directly attached to the outer wall along a series of parallel spaced longitudinal ridges which divide the chamber of each half into a plurality of longitudinal channels. Each of the ridges, however, is provided with a plurality of transverse passageways connecting the channels together so that a freezable liquid can flow from one channel to the next adjacent channel. Each section is provided with an opening through which a freezable liquid can be introduced and each opening is adapted to threadedly receive a cap to close over the opening.

The inner shell or wall of each section is configured to form a plurality of internal recesses so that, when the two halves are placed together in closed position, the recesses of one half mate with the recesses of the other half to form cavities of predetermined sizes and shapes which are adapted to receive objects therein. In one form of the invention, the inner walls of each container half are configured so that there are provided three parallel cylindrical recesses adapted to hold, for example, six cylindrical cans or beverages. The recesses are sufficiently close to each other so that the cans in one recess will contact the cans in an adjacent recess tangentially so as to provide direct heat transfer from one row of cans to an adjacent row of cans.

In another form of the invention, the inner walls of the container halves are formed so as to provide one cylindrical recess for holding two cans of beverages, for example, and a rectangular recess for holding sandwiches and the like.

In still another form of the present invention, the inner walls of the container halves are configured to form recesses which are shaped to accommodate two necked bottles.

DETAILED DESCRIPTION OF THE PREFERRED EMBODIMENTS

Figure 3:
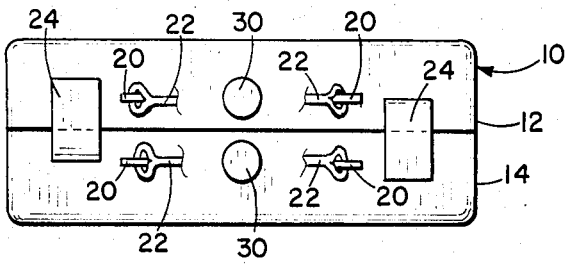
FIG. 3 is a top view of the invention of FIG. 1.

FIGS. 1, 2, 3, and 4 show various views (in reduced size) of one embodiment of a thermal cooler 10 designed in the form of a traveling or attache-type case and consisting of a joined pair of identical or symmetrical sections 12 and 14 which encase beverage containers and foodstuffs thus insulating them against the higher exterior temperatures. Each section (12 or 14) is made of a floatable, hollow, thermoplastic outer skin or shell having high heat insulative properties. Each section (12 or 14) rests on a pair of raised feet 16 spaced at the bottom thereof between a pair of connecting straps 18 which prevent the two sections (12 and 14) from becoming separated one from another and possibly lost.

FIG. 3 shows a top view of the attache cooler with each symmetrical section (12 and 14) having a pair of thermoplastic cord handle "eyes" 20 molded thereon, through which pass a pair of plastic boating cord handles 22 thereby making the container easily portable so it can be transported as part of a back pack or by motorcycle, automobile, canoe, boat, bicycle, or horseback rider. At the top of the thermal cooler are a pair of notched or snapping flaps 24, each facing the opposite direction, which allow the twin sections of the plastic shell (12 and 14) to be securely closed or latched by snapping the flaps 24 over a pair of protruding notches 26 (See now FIGS. 5, 6, 9, and 10). These notches and snapping flaps constitute a latch means for the upper ends of the container halves 12 and 14. One notch and one flap are located at the upper end of each half in such a manner that the notch on one half is disposed opposite the snapping flap on the other half, each snapping flap being adapted to be received over the opposed notch on the opposite half to hold the two halves securely together in closed position. The outer end of each snapping flap 24 is provided with a complimentary shaped recess as shown adapted to receive the notch 26.

Figure 1:
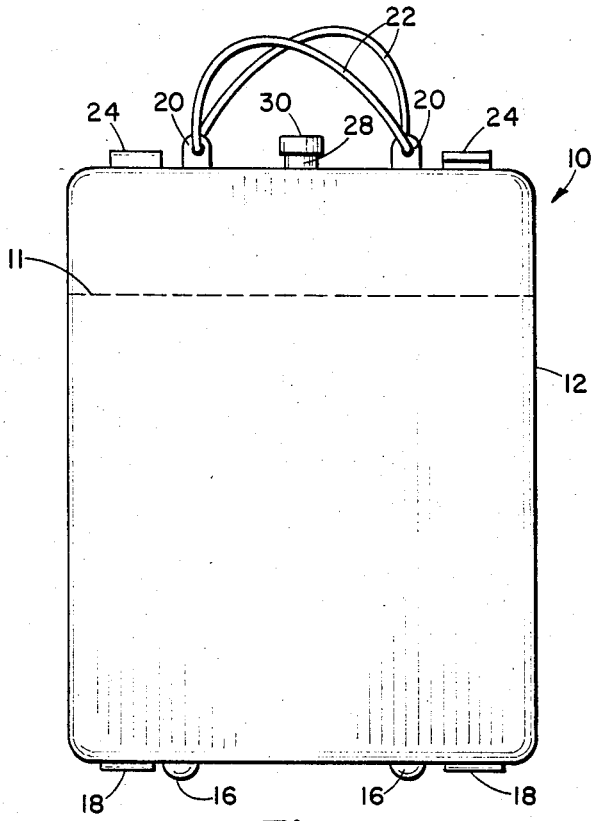
FIG. 1 is a frontal view of one embodiment of the present invention in the form of a traveling case or attache case which is shown in the closed or carrying position.
Figure 2:
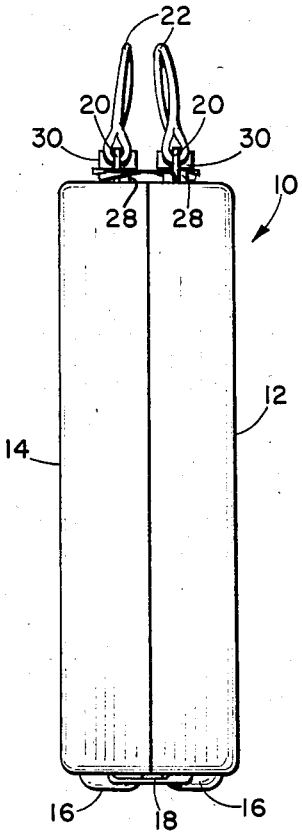
FIG. 2 is a side view of the invention of FIG. 1.
Figure 4:
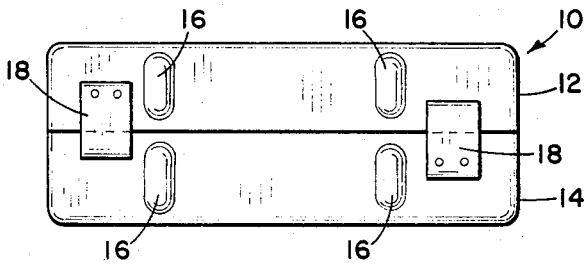
FIG. 4 is a bottom view of the invention of FIG. 1.

FIGS. 1 to 3 also show the attache cooler 10 with a pair of openings 28, each of which threadedly receives a pair of caps 30 which permit the thermal cooler 10 to be filled to a freeze line 11 with freezable liquid such as water. This unit 10 can then be placed in a freezer compartment until the liquid changes into an ice state thereby making the whole unit 10 a thermal cooler. Air space above the freeze line 11 is designed to allow for expansion of the freezable liquid within and makes the unit floatable.

Figure 5:
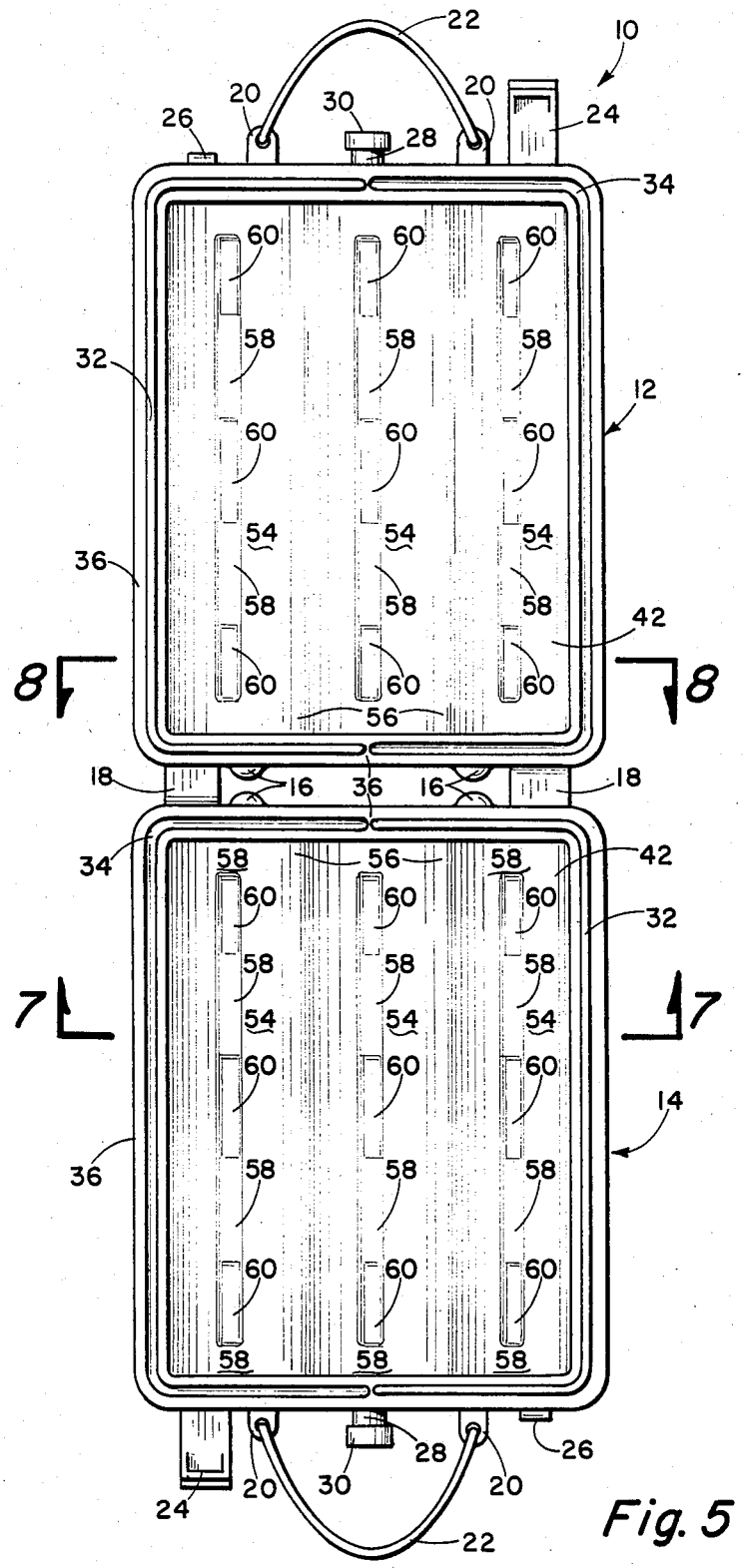
FIG. 5 is a frontal view of the invention of FIG. 1 with the case in a fully opened condition and showing an inner configuration as designed for the purpose of holding a plurality of beverage cans.

FIG. 5 is a frontal view of the thermal cooler 10 of FIG. 1 with the case in a fully opened condition and showing the inner configurations of twin sections 12 (top) and 14 (bottom) as designed for the purpose of holding a plurality of beverage cans (not here shown). This view shows each opposite notched flap 24 in an open position and each notch catch 26 protruding upwards so as to provide a grasp for flaps 24 which, when closed, provide a secure receptable for insulating the contents against a higher exterior temperature.

Figure 6:
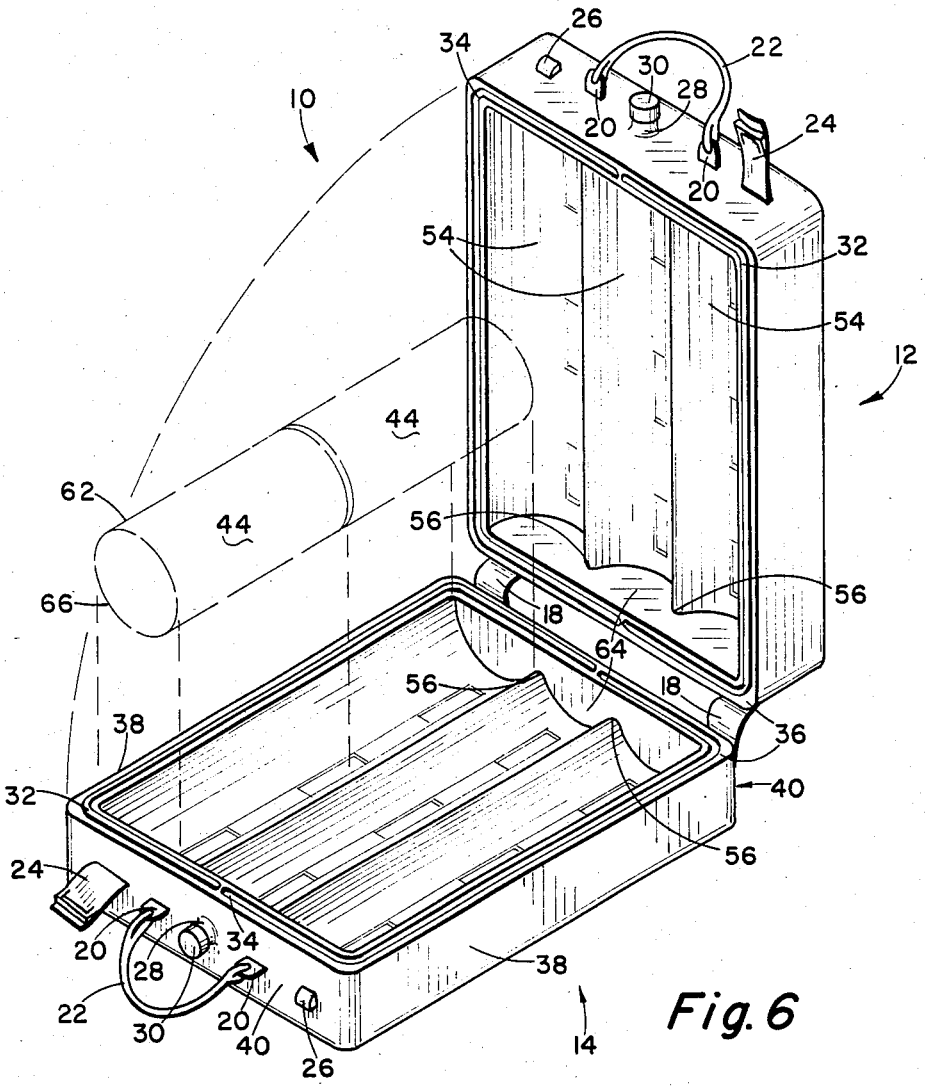
FIG. 6 is a perspective view of the invention of FIG. 1 in a partly opened condition and showing an inner configuration as designed for the purpose of holding beverage cans, two such cans being shown in dashed lines.
Figure 7:
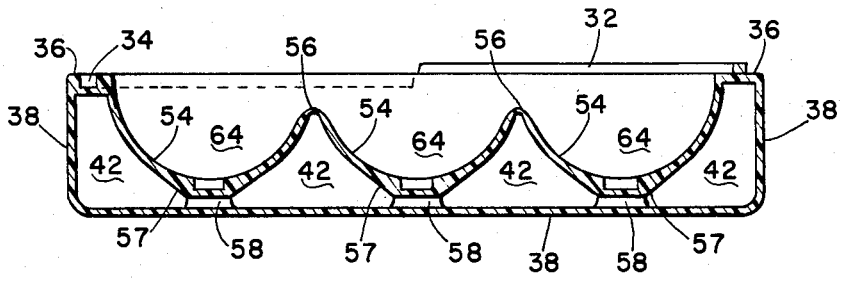
FIG. 7 is a cross-sectional view taken along section line 7—7 of FIG. 5.
Figure 8:
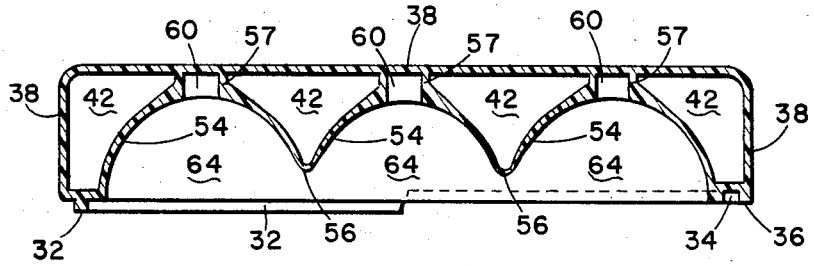
FIG. 8 is a cross-sectional view taken along section line 8—8 of FIG. 5.

FIG. 5 also shows the twin sections 12 and 14 separated along a median plane by a raised tongue 32 which fits into a complementary recessed groove 34 of the opposite twin section; each tongue 32 and groove 34 follows the rectangular perimeter of each twin section 12 and 14 thereby providing, together with the notch catches 26 and flaps 24 (in a closed position), an air-tight means for securing the contents of the thermal cooler 10. The tongue 32 and groove 34 extend longitudinally around the interfacing joint surfaces 36 of the cooler 10. FIGS. 6, 7, and 8 show said joint surfaces 36 which extend transversely between the upright side walls 38 and longitudinally between the opposing end walls 40.

The attache case or sandwich-style container 10, formed by the twin pair of rectangular sections 12 and 14, includes, in each section, a hollowed-out recess 42 capable of being molded or shaped to accommodate a variety of inner-designed configurations. In the embodiment shown in FIGS. 1 through 5, it is preferred that the cooler shell be of sufficient length to contain and insulate a six-pack of 12 fluid ounce beverage cans 44 (as shown in FIGS. 5 and 6). However, in another embodiment, a series of compartments 46 designed to hold fewer beverage cans 44 plus an area of foodstuffs 48 (see now FIG. 9), or in yet another embodiment, a compartment 50 molded to conform with the outside configuration or shape of any object or product which needs to be kept cold (as shown with the beverage bottle 52 in FIG. 10) may be preferred as a matter of demand and/or manufacturing choice.

FIGS. 7 and 8 show cross-sectional views of the hollow plastic container 10 taken along section lines 7—7 and 8—8 of FIG. 5. Outer walls 38 and 40 of each of the twin sections 12 and 14 are hollow because each section is made of a thermoplastic, floatable outer skin or shell which is connected to, yet separated from, an inner shell (as will be described hereinafter).

The basic inner configuration of the thermal cooler (as shown in FIGS. 5 and 6) is designed to include a trio of channeled inner walls 54 which can hold a series of substantially cylindrical beverage containers 44 which contact the inner surfaces of this trio of channels 54 plus each other and cool by the conduction method. The walls of these channels 54, which are semi-cylindrical and concave, are complementary to the cylindrical configuration of the cans to be received and become progressively thinner as they reach a series of triangular-veined apex points 56, thereby allowing greater cold conduction to pass from the freezable inner contents of recess 42 into the beverage containers 44. The hollowed-out recess 42 ultimately receives the freezable liquid. The inner walls 54 are designed, as shown in the cross-sectional view shown in FIG. 7, to form three continuous longitudinal connections 57 with the outer wall 38 along the locations where the lower centers of curvature of the channels merge with the outer walls. However, these longitudinal connections include a series of alternately-spaced intervals which are designed to form passages 58 through which the freezable liquid can freely flow. In the cross-sectional view shown in FIG. 8, the longitudinal connections 57 are not channeled, but form a permanent portion of said outer shell wall, the resulting shape forming a plurality of rectangular recesses 60 on opposite sides of the passages 58.

The semi-cylindrical and concave channels 54 are formed along axes which are parallel to one another and which lie along planes defined by the interfacing joint surfaces 36. The channels 54 are also spaced by said triangular-veined, apex divider-points 56 within each of the sections 12 and 14. These points 56 are not coplanar with the interfacing joint surfaces 36, but are spaced outwardly therefrom. When sections 12 and 14 are joined together, said points 56 define the hollowed-out recess into which the beverage container sides 62 extend to touch tangentially. Each container 44 will therefore tangentially engage an adjacent container 44 so heat or cold can be transmitted between the two by conduction. The divider points 56 are arranged so each container 44 held therein will touch an adjacent container 44 in an adjacent row.

One end of each channel 54 terminates at an inner end surface 64. Said end surfaces 64 abut ends 66 of beverage containers 44 thereby aligning said containers in a row with said container ends situated in parallel planes.

Although the drawings in FIGS. 5, 6, 7, and 8 reveal a series of cylindrically-shaped channels 54, the thermoplastic container 10 may be designed in separate embodiments (see now FIGS. 9 and 10) which have the same functional parts as shown in FIGS. 1 to 6.

Figure 9:
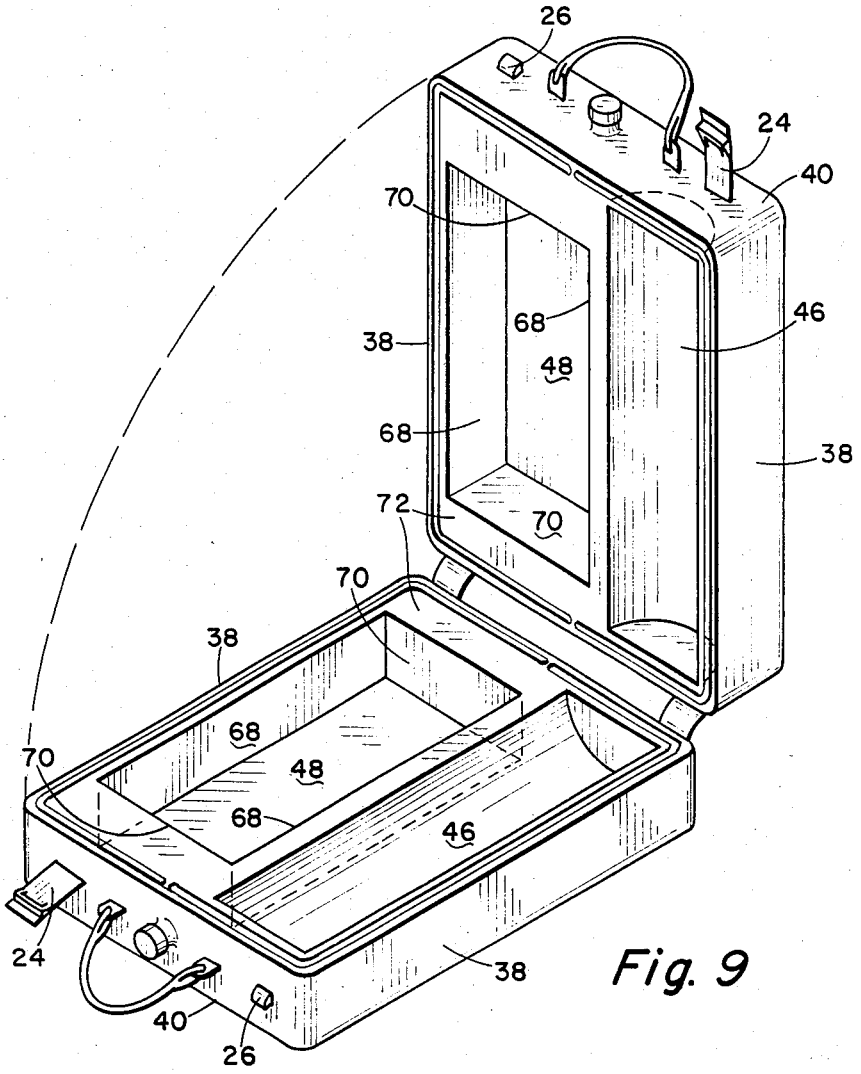
FIG. 9 is a perspective view similar to FIG. 6 showing a modified form of the present invention having an inner configuration designed for holding picnic-type foodstuffs as well as beverage cans.

FIG. 9 reveals an interior of the hollow container 10 basically formed into channels 46 which are identically devised as those referenced by number 54 in FIG. 5, plus a compartment 48 formed of walls designed to conform with the outside configuration or shape of any object or product which needs to be kept cold. Compartment 48 is designed to hold foodstuffs, such as sandwiches, and has a pair of side walls 68 and a pair of end walls 70. These side walls 68 are parallel to outer side walls 38 of the cooler 10 and join with inner end walls 70, which are also parallel to outer end walls 40, to form a sizeable space such as would be required to accommodate foodstuffs packed for a picnic lunch, for example. The hollowed-out recess (not shown) of the FIG. 9 embodiment receives a freezable liquid which, in this case, fills a substantially thicker side and end wall area 72 thus enabling this embodiment of the present invention to cool perishable meats, cheeses, or other picnic or luncheon foods.

Figure 10:
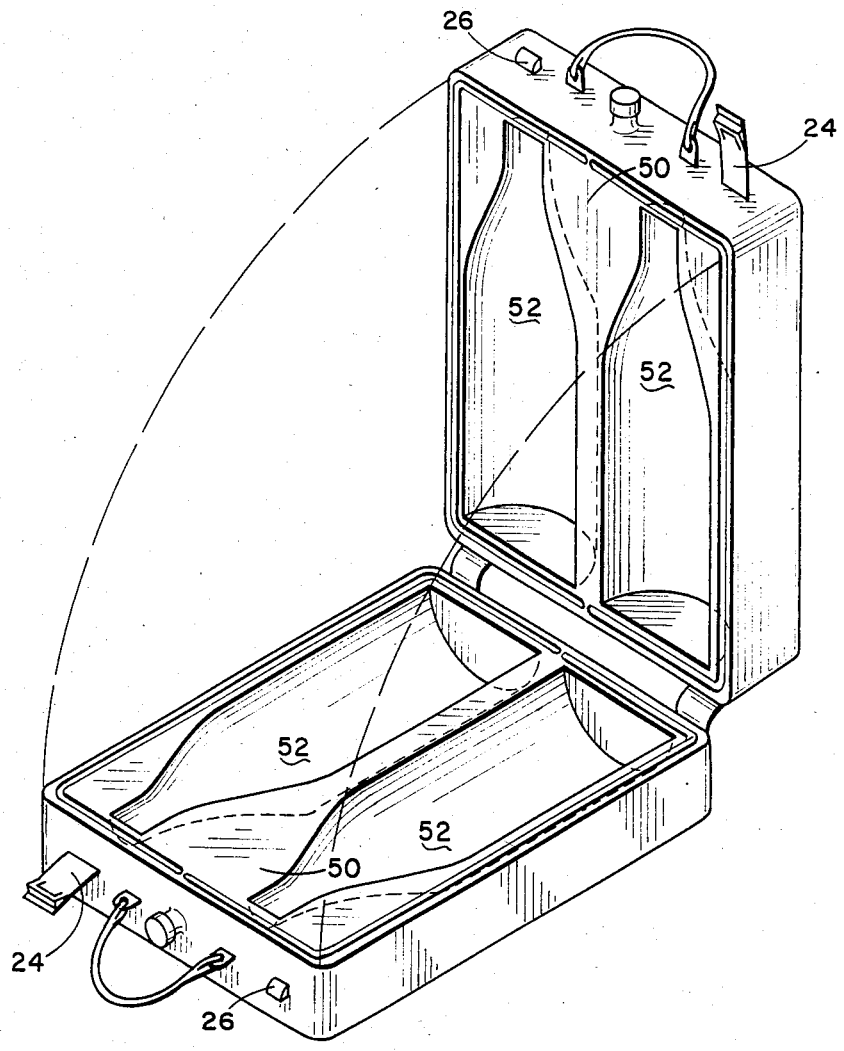
FIG. 10 is a perspective view similar to FIGS. 6 and 9 showing another modified embodiment of the present invention having an inner configuration designed for holding small-necked beverage bottles.

FIG. 10 is yet another embodiment of the present invention and has substantially the same design and component parts with the exception of the interior which is designed to surround a pair of narrow-necked beverage bottles (not shown). The inner side walls 50 are free formed in shape and are substantially thicker than the walls of the first embodiment of the present invention.

The purpose of the invention is to keep liquids chilled in their respective and varying shaped containers, i.e., wine in bottles, pop or beer in cans, and even alcoholic beverages in bottles. By adding water through openings 28 in each twin section (12 and 14) of the container 10 and then freezing, the outer shell can provide cold insulation while the beverages are in use at a lake or beach, in a boat, or around the backyard or swim club pool.

The thermal coolers, which can be refrozen and refilled or drained as needed, are to be molded basically of a thermoplastic material, but can be made from other materials. Carbonated beverages, tea, lemonade or any other freezable beverage may be substituted for water. When the freezable liquid melts, it can provide an extra beverage source. Thus, the device can also serve as an emergency canteen.

Whereas the present invention has been described in particular relation to the drawings attached hereto, it should be understood that other and further embodiments, apart from those shown or suggested herein, may be made within the spirit and scope of this invention.

What is claimed is:

1. A self-contained, portable, storage container styled in the form of a hollow attache case and characterized by an ability to maintain a plurality of objects contained therein at a desired cool temperature for relatively long periods of time comprising:

a pair of symmetrical container halves, each having an upper end, a lower end, two sides, and a plurality of internal recesses, so that in a closed position, the recesses of one half mate with recesses of the other half to form cavities of predetermined sizes and shapes which are adapted to receive said objects therein;

means for hingedly connecting the lower ends of the two halves together;

latch means for connecting the upper ends of the two halves together to hold them in closed position against each other;

each half having an outer wall and an inner wall spaced from the outer wall so as to form a chamber for receiving therein a freezable liquid;

said inner wall being connected to said outer wall along a plurality of spaced longitudinal ridges dividing said chamber into a plurality of longitudinal channels, each of said ridges being provided with a plurality of transverse passageways connecting said channels together so that freezable liquid can flow from one channel to the next adjacent channel; and means for introducing a freezable liquid into each chamber;

wherein said latch means comprises a pair of protruding notches and a pair of snapping flaps, one notch and one flap being located at the upper end of each half in such a manner that the notch on one half is disposed opposite the snapping flap on the other half, each snapping flap being adapted to be received over the opposed notch on the opposite half to hold the two halves securely together in closed position.

2. A self-contained, portable, storage container styled in the form of a hollow attache case and characterized by an ability to maintain a plurality of objects contained therein at a desired cool temperature for relatively long periods of time comprising:

a pair of symmetrical container halves, each having an upper end, a lower end, two sides, and a plurality of internal recesses, so that in a closed position, the recesses of one half mate with recesses of the other half to form cavities of predetermined sizes and shapes which are adapted to receive said objects therein;

means for hingedly connecting the lower ends of the two halves together;

latch means for connecting the upper ends of the two halves together to hold them in closed position against each other;

each half having an outer wall and an inner wall spaced from the outer wall so as to form a chamber for receiving therein a freezable liquid;

said inner wall being connected to said outer wall along a plurality of spaced longitudinal ridges dividing said chamber into a plurality of longitudinal channels, each of said ridges being provided with a plurality of transverse passageways connecting said channels together so that freezable liquid can flow from one channel to the next adjacent channel; and means for introducing a freezable liquid into each chamber;

wherein the cavities are contoured and dimensioned so as to contact a substantial percentage of the outer surfaces of a plurality of cylindrical beverage containers placed in heat exchange contact there-with and wherein the cavities are spaced apart on parallel axes so that adjacent beverage containers received therein will contact one another tangentially; and wherein the attache case is shaped in the form of a rectangular parallelepiped the width dimension of which is slightly greater than the outside diameter of the cans and wherein the length dimension is slightly greater than a multiple of can lengths.

3. A self-contained, portable, storage container styled in the form of a hollow attache case and characterized by an ability to maintain a plurality of objects contained therein at a desired cool temperature for relatively long periods of time comprising:

a pair of symmetrical container halves, each having an upper end, a lower end, two sides, and a plurality of internal recesses, so that in a closed position, the recesses of one half mate with recesses of the other half to form cavities of predetermined sizes and shapes which are adapted to receive said objects therein;

means for hingedly connecting the lower ends of the two halves together;

latch means for connecting the upper ends of the two halves together to hold them in closed position against each other;

each half having an outer wall and an inner wall spaced from the outer wall so as to form a chamber for receiving therein a freezable liquid;

said inner wall being connected to said outer wall along a plurality of spaced longitudinal ridges dividing said chamber into a plurality of longitudinal channels, each of said ridges being provided with a plurality of transverse passageways connecting said channels together so that freezable liquid can flow from one channel to the next adjacent channel; and means for introducing a freezable liquid into each chamber;

wherein the container halves are provided with joint surfaces which abut each other when the two halves are in closed position, each joint surface being provided with a tongue and groove arrangement extending around the periphery of the joint surface, whereby the tongue and groove arrangement of one container half will mate with the tongue and groove arrangement of the other container half in the closed position.

* * * * *